US010428829B2

(12) United States Patent
Gebert et al.

(10) Patent No.: US 10,428,829 B2
(45) Date of Patent: Oct. 1, 2019

(54) FAN WITH FAN WHEEL AND GUIDE WHEEL

(71) Applicant: ebm-papst Mulfingen GmbH & Co. KG, Mulfingen (DE)

(72) Inventors: Daniel Gebert, Öhringen (DE); Thomas Heli, Langenburg (DE); Eugen Kleinhanss, Mulfingen (DE); Ann-Kathrin Löber, Dörzbach (DE)

(73) Assignee: EBM-PAPST MULFINGEN GMBH & CO. KG, Mulfingen (DE)

( * ) Notice: Subject to any disclaimer, the term of this patent is extended or adjusted under 35 U.S.C. 154(b) by 65 days.

(21) Appl. No.: 15/786,842

(22) Filed: Oct. 18, 2017

(65) Prior Publication Data

US 2018/0106267 A1 Apr. 19, 2018

(30) Foreign Application Priority Data

Oct. 19, 2016 (DE) ..... 10 2016 119 916

(51) Int. Cl.

| | |
|---|---|
| ***F04D 29/32*** | (2006.01) |
| ***F04D 19/00*** | (2006.01) |
| ***F04D 29/54*** | (2006.01) |
| ***F15D 1/02*** | (2006.01) |
| *F04D 29/66* | (2006.01) |

(52) U.S. Cl.

CPC ..... *F04D 29/329* (2013.01); *F04D 19/002* (2013.01); *F04D 29/542* (2013.01); *F04D 29/544* (2013.01); *F04D 29/545* (2013.01); *F15D 1/02* (2013.01); *F04D 29/667* (2013.01)

(58) Field of Classification Search

CPC .... F04D 29/547; F04D 25/082; F04D 29/325; F04D 19/002; F04D 25/0646

See application file for complete search history.

(56) References Cited

U.S. PATENT DOCUMENTS

| | | | | |
|---|---|---|---|---|
| 4,630,993 | A * | 12/1986 | Jensen | F04D 29/547 415/58.7 |
| 6,514,052 | B2 * | 2/2003 | Bostwick | F04D 17/105 416/189 |
| 6,599,088 | B2 * | 7/2003 | Stagg | F01D 5/143 415/173.6 |
| 7,478,993 | B2 * | 1/2009 | Hong | F04D 29/547 415/173.1 |
| 9,097,261 | B2 | 8/2015 | Haaf | |
| 2011/0114286 | A1 * | 5/2011 | Komatsu | B60K 11/04 165/51 |
| 2015/0330411 | A1 | 11/2015 | Heli | |
| 2016/0252098 | A1 * | 9/2016 | Reynolds | F04D 29/684 415/1 |

* cited by examiner

*Primary Examiner* — Long T Tran

(74) *Attorney, Agent, or Firm* — Scully, Scott, Murphy & Presser, P.C.

(57) ABSTRACT

The invention relates to a fan having a fan wheel (2) comprising fan blades (3), which fan wheel extends radially outwards about a rotational axis of the fan (1) and whose outer radial circumference defines a fan wheel diameter (Dv), and a stator (4) with air deflecting webs (5) disposed in the axial direction of flow at a distance (A) from the fan wheel (1), which stator extends radially outwards and has a stator diameter (Dl) that is smaller than the fan wheel diameter (Dv), such that the stator (4) defines a partial cross sectional area of a fan wheel cross sectional area.

14 Claims, 4 Drawing Sheets

FAN WITH FAN WHEEL AND GUIDE WHEEL

The invention relates to as fan with a fan wheel and a stator.

The use of stators for fans is not known from prior art. For example, DE 10 2012 109 542 A1 discloses an axial fan with a stator that is designed as a flow rectifier, which in the technical field is also called an "outlet guide vane".

It has been assumed for known stators that they have their greatest fluidic and noise-reducing effect in an outer radial area of fans or fan wheels, since the rate of the air flow generated by the fan in this area is at its maximum. The stator is to homogenize the flow and to prevent a backflow to the fan wheel that has a negative impact on efficiency and noise characteristics. The known solution of the above-mentioned prior art works well in practice, but it can be further improved to achieve other positive aspects with respect to the installation space needed, the flow path, and noise characteristics.

It is therefore a problem of the invention to provide a fan with a stator that allows a compact axial design and at the same time improves flow characteristics.

This problem is solved, according to the invention, by a combination of features according to claim 1.

According to the invention, a fan is proposed having a fan wheel with fan blades that extends radially outwards about a rotational axis of the fan and whose radial outer circumference determines the fan wheel diameter. The fan also includes a stator with air deflecting webs disposed in the axial direction of flow at a spacing to the fan wheel, which stator also extends radially outwards and has a stator diameter that is less than the fan diameter, such that the stator defines a partial cross-sectional area of a fan cross-sectional area.

The smaller diameter of the stator compared to the fan wheel makes it possible to reduce the spacing between the fan wheel and the stator, i.e. to position the stator closer to the fan wheel in the direction of flow. This reduces the installation size of the fan in the axial direction of flow, and it improves its noise characteristics. The generally known effect of homogenizing the flow and preventing a backflow is retained. In addition, the stator can be mounted as a retrofittable part to existing fans, due to its minimal installation space requirements.

Another advantageous aspect of the stator having a smaller diameter than the fan wheel is that the differential pressure across the smaller cross section, which reduces the risk of icing in refrigeration applications.

In an advantageous embodiment of the fan, the fan wheel comprises a fan wheel hub and an adjoining flow-through blade section which extends in the radial direction from the fan wheel hub to the outer circumference of the fan wheel. The stator in addition includes a stator hub and an adjoining guide section that extends from the stator hub to the outer circumference of the stator. It is advantageous that the diameter ratio of the guide section to the blade section is in a range from 0.1 to 0.8, more preferably in a range from 0.2 to 0.5. The stator hub does not have to be a separate component; instead, the stator hub can be formed by elements of other components, such as a motor housing.

In a further development, the stator is configured at a width in the axial direction of flow of 0.01 to 0.2 (i.e. 1%-20%) of the fan wheel diameter, more preferably 0.02 to 0.1 (i.e. 2%-10%) of the fan wheel diameter. This means that the reference variable for dimensioning the width of the stator is the fan wheel diameter.

The geometric configuration of the stator has direct fluidic effects, wherein the dimensions described above, both individually and cumulatively, result in a reduction of the turbulent portions and the radial component in the inner radial region of the air flow generated by the fan. The discharge angle on the median plane approximated the optimum value of zero, such that the backflow that typically occurs in the hub or inner radial region is eliminated against the direction of flow generated.

The positive effect of the stator and the compact design are further enhanced in that the minimum distance in the axial direction of flow between the fan wheel and the stator is in a range from 0.01 to 0.2, more preferably in a range from 0.01 to 0.05 of the fan wheel diameter.

An embodiment in which the stator comprises an outer circumferential ring on its radial outer circumference is also fluidically favorable. The outer circumferential ring is preferably designed with a thin wall and has a radial thickness corresponding to 0.002 to 0.015 of the fan wheel diameter.

It is further advantageous if the outer circumferential ring is designed to completely surround the stator and is non-angular in axial cross section. In addition to its fluidic influence, the outer circumferential ring benefits an increase in rigidity of the stator.

In an advantageous further development, the outer circumferential ring extends radially outwards in the direction of flow at an angle $\beta$ of 5-25°, more preferably of 5-10°, relative to the rotational axis.

Another embodiment of the fan is characterized in that the stator hub extends radially outwards in the axial direction of flow at an angle $\alpha$ of up to 60° relative to the rotational axis, i.e. the stator hub is cone-shaped in the direction of flow.

As an alternative solution, the stator can comprise an inner ring radially adjacent to the stator hub, which inner ring extends radially outwards in the axial direction of flow, preferably across the entire width of the stator, at an angle $\alpha$ of up to 60° relative to the rotational axis. Arranging the stator hub or the inner ring that is adjacent to the stator hub at an angle conducts the air flow generated by the fan wheel in the inner radial region radially outwards, away from the rotational axis of the fan.

In addition, an embodiment has proved advantageous in which the angle $\alpha$ is greater than the angle $\beta$.

Another fluidically favorable embodiment is characterized in that the stator hub or the inner ring and the outer circumferential ring together form a nozzle that has a flow cross section that diminishes in the direction of flow.

The deflecting webs are preferably designed in a manner according to the disclosure of DE102012109542A1. The respective disclosure content becomes an integral part of this disclosure. Other components to be routinely provided for the fan, such as a motor and a drive shaft, are also included even though they are not expressly described. Other advantageous further developments of the invention are characterized in the dependent claims or are explained in more detail below with reference to the figures and together with a preferred embodiment of the invention. Wherein:

Like reference symbols identify like components in all views. All figures are purely schematic and intended to help understand the invention.

Figure 1:
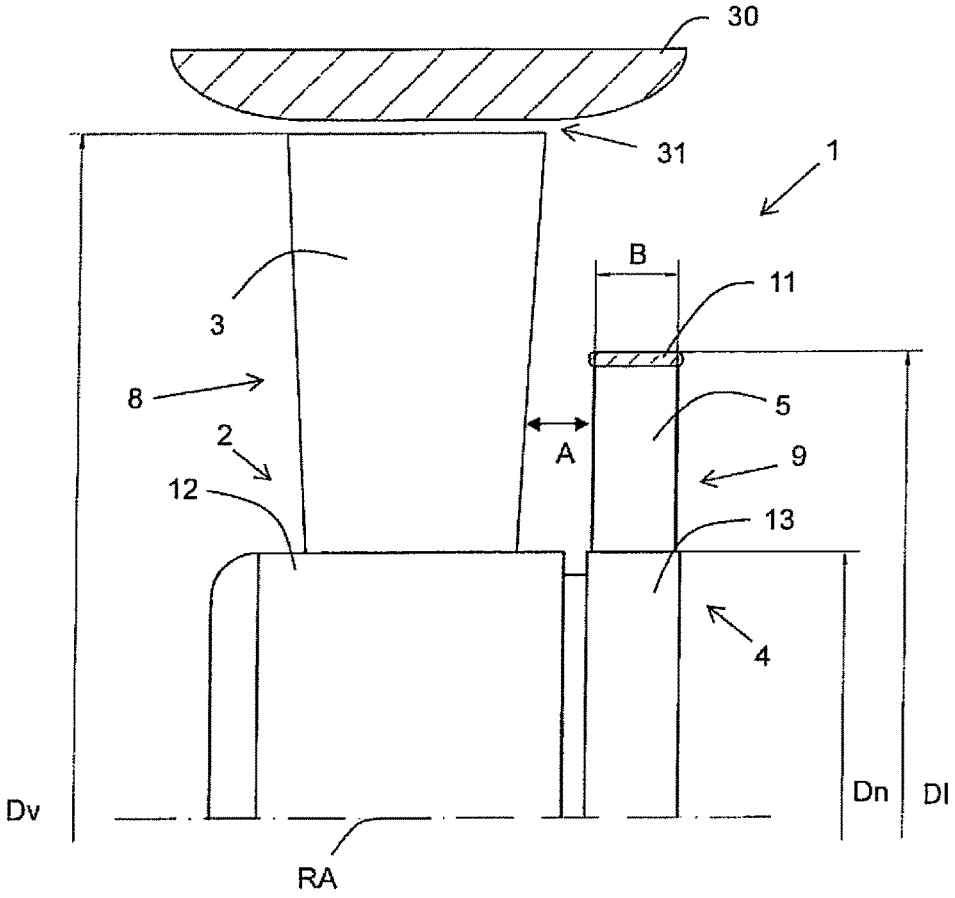
FIG. 1 shows a schematic cross sectional side view of a fan according to the invention.

FIG. 1 shows an axial section of the top half of an (axial) fan 1 with a fan wheel 2 extending radially outwards about the rotational axis RA of the fan 1 and a stator 4 disposed at a very small distance A from the fan wheel 2 in the axial direction of flow, wherein said distance A is equivalent to a value of 0.02 of the fan wheel diameter Dv. The bottom half of the fan 1, which is not shown, is symmetrically identical. The fan wheel 2 comprises multiple fan blades 3 disposed at a spacing from one another, each of which extending radially outwards from the fan wheel hub 12 with increasing axial width. Alternative shapes of fan blades known from prior art can be used for all embodiments. The radially outer free end of the fan wheel blades 3 defines the outer circumference and thus the fan wheel diameter Dv. Also indicated is a housing part 30 forming a flow channel into which the fan 1 is inserted at a gap clearance 31 between the fan blades 3 and the inner wall of the housing part 30. The housing part 30 can be an external component or integrated in the fan.

The stator 4 includes a plurality of air deflecting webs 5 running in the axial direction through the stator and extending radially outwards from the stator hub 13 to the outer circumferential ring 11. The maximum stator diameter DI is smaller than the fan wheel diameter Dv. Since the stator 4 and the fan wheel 2 are arranged so as to overlap each other, the stator 4 defines a partial cross sectional area capable of through-flow of the fan wheel cross sectional area capable of through-flow. The cross sectional areas capable of through-flow are formed by the blade section 8 extending radially outwards from the fan wheel hub 12 and the guide section 9 extending radially outwards from the stator hub 13, wherein the diameter ratio of the guide section 9 to the blade section 8 is 0.4 in the embodiment shown. The radially outer part of the blade section 8 is not covered by the stator 4, such that a portion of the flow generated by the fan wheel 2 first flows through the stator 4, another portion flows directly outwards in the axial direction.

The outer circumferential ring 11 runs parallel to the rotational axis RA, substantially across the entire width B of the stator 4 and is designed as a thin-walled ring whose thickness is equivalent to a value of 0.01 of the fan wheel diameter Dv. The width B of the stator 4 is equivalent to a value of 0.065 of the fan wheel diameter Dv. The fan wheel hub 12 and the stator hub 13 have the same hub diameter Dn.

Figure 2:
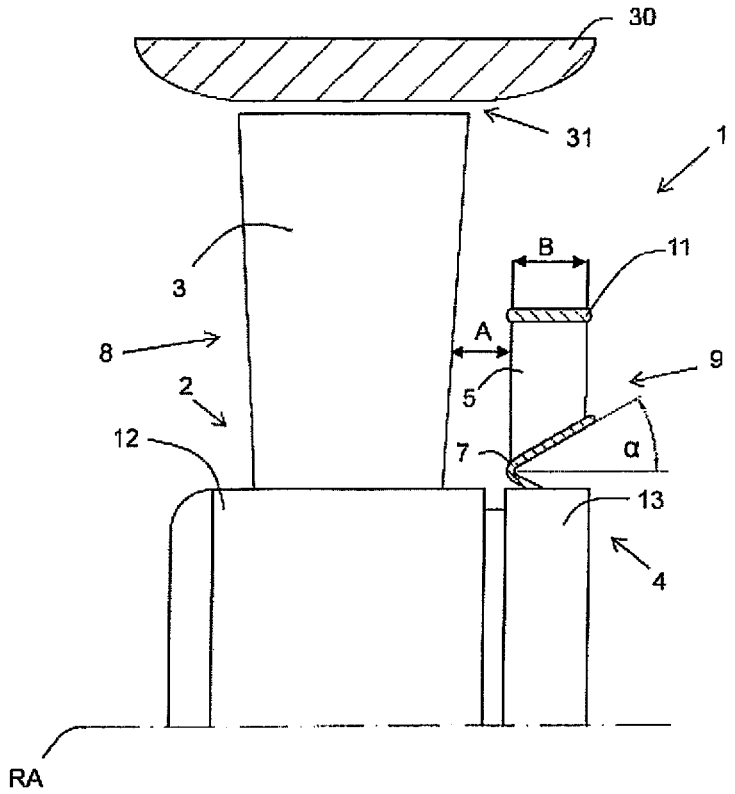
FIG. 2 shows a schematic cross sectional side view of another embodiment of a fan according to the invention.

The embodiment according to FIG. 2 is identical with that of FIG. 1 except for the stator; we refer to the features described in FIG. 1 to avoid repetition. The stator 4 of the embodiment according to FIG. 3 includes an additional inner ring 7 which has a section arranged at an angle $\alpha$ of 40° relative to the rotational axis RA and extends obliquely radially outwards in the axial direction of flow across the entire width B of the stator 4. In the axial sectional view shown, the inner ring 7 has a V-shaped cross section with a limb engaging at the stator hub 13 and a limb forming the section arranged at an angle. The inner ring 7 effectively prevents an axial backflow of air in the direction of the fan wheel 2 in the radially interior section adjacent to the hubs 12, 13.

Figure 3:
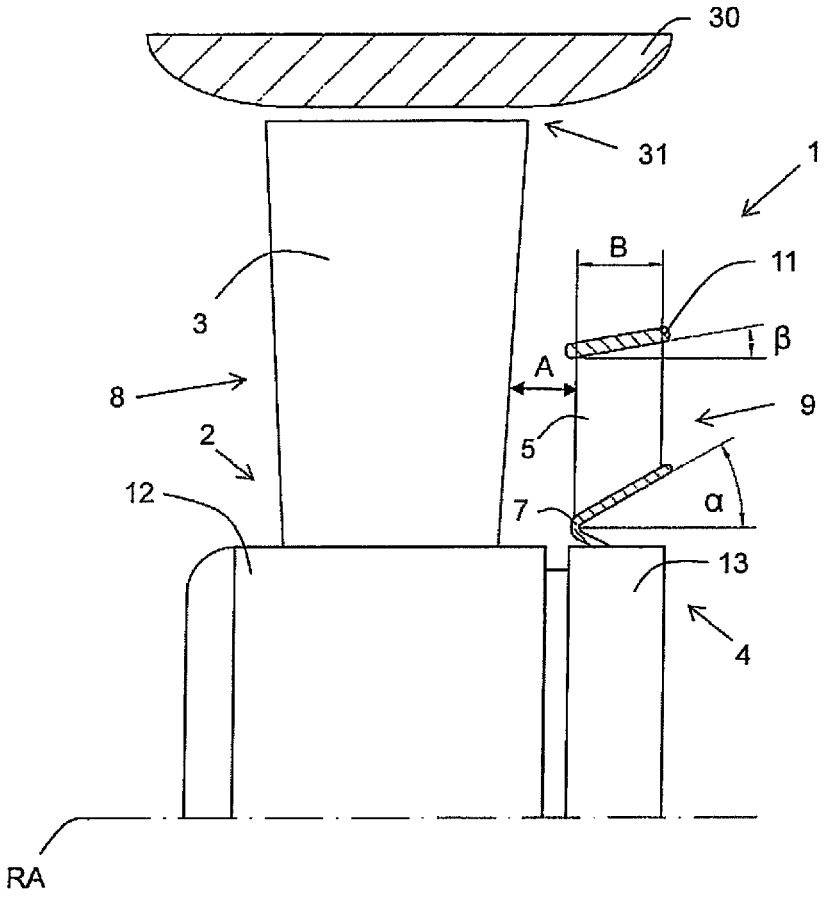
FIG. 3 shows a schematic cross sectional side view of another embodiment of a fan according to the invention.

The embodiment according to FIG. 3 is identical with the one shown in FIG. 2, except that the outer circumferential ring 11 is modified. We will therefore refer to the disclosure in FIGS. 1 and 2 to avoid repetition. According to FIG. 3, the outer circumferential ring 11 is arranged at an angle $\beta$=10° relative to the rotational axis RA and extends radially outwards in the axial direction of flow. The stator 4 thus forms a nozzle by means of the inner ring 7 and the outer circumferential ring 11, which nozzle has a flow cross section that diminishes in the direction of flow. Due to the oblique arrangement of the outer circumferential ring 11, the maximum stator cross section increases by the length of the opposite side of the angle $\beta$.

Figure 4:
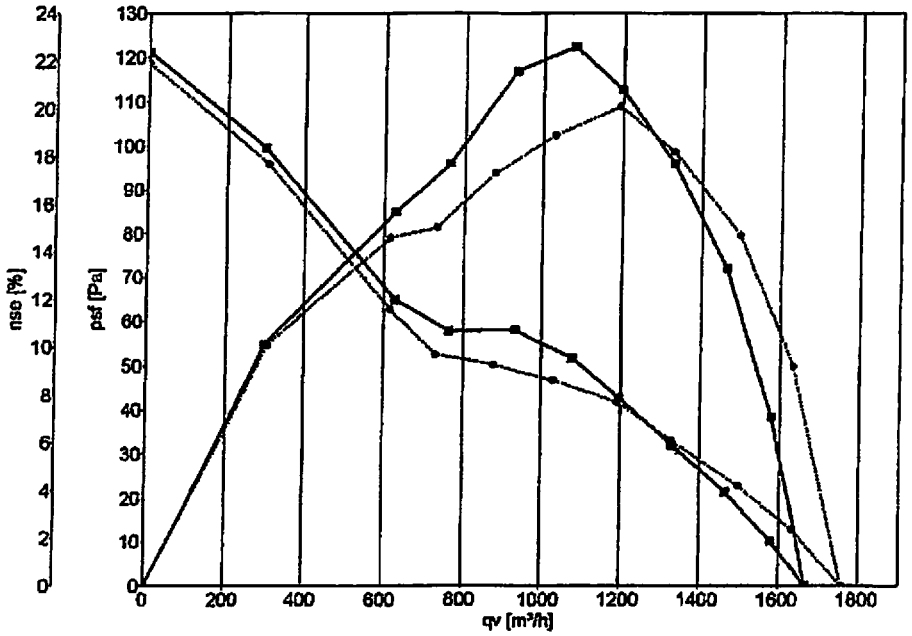
FIG. 4 shows a diagram of curves of the fan according to FIG. 1 and according to prior art without a stator.

FIG. 4 is a diagram with characteristic curves for the pressure profile psf [Pa] and efficiency nse [%] at different volumetric flows qv [$m^3$/h] of the fan 1 according to FIG. 1 and the same fan without a stator 4, wherein the solid characteristic curves each identify the fan 1 according to FIG. 1 and the dashed characteristic curves each identify the fan without a stator. The advantageous effect with an increased peak efficiency at a volumetric flow of approx. 1100 $m^3$/h and higher pressure up to approx. 1300 $m^3$/h, that is, in the highly relevant operating range, can clearly be derived.

The invention claimed is:

1. A fan having a fan wheel comprising fan blades, which fan wheel extends radially outwards about a rotational axis of the fan and whose outer radial circumference defines a fan wheel diameter (Dv), and a stator with air deflecting webs disposed in the axial direction of flow at a distance (A) from the fan wheel, which stator extends radially outwards and has a stator diameter (DI) that is smaller than the fan wheel diameter (Dv), such that the stator defines a partial cross sectional area of a fan wheel cross sectional area, wherein the fan wheel comprises a fan wheel hub and an adjoining blade section that extends in a radial direction from the fan wheel hub to the outer circumference of the fan wheel, and in that the stator comprises a stator hub and an adjoining guide section that extends in a radial direction from said stator hub to the outer circumference of the stator, wherein the diameter ratio of the guide section to the blade section is in a range from 0.1 to 0.8, and wherein the stator comprises an inner ring radially adjacent to the stator hub, which inner ring extends radially outwards in the axial direction of flow across the entire width (B) of the stator at an angle $\alpha$ of up to 60° relative to the rotational axis.

2. The fan according to claim 1, wherein the diameter ratio of the guide section to the blade section is in a range from 0.2 to 0.5.

3. The fan according to claim 1, wherein the stator has a width (B) in the axial direction of flow that is equivalent to 0.01 to 0.2 of the fan wheel diameter (Dv).

4. The fan according claim 3, wherein the stator has a width (B) in the axial direction of flow that is in a range from 0.02 to 0.1 of the fan wheel diameter (Dv).

5. The fan according to claim 1, wherein the distance (A) in the axial direction of flow between the fan wheel and the stator is in a range from 0.01 to 0.2, of the fan wheel diameter (Dv).

6. The fan according to claim 5, wherein the distance (A) in the axial direction of flow between the fan wheel and the stator is in a range from 0.01 and 0.05 of the fan wheel diameter (Dv).

7. The fan according to claim 1, wherein the stator comprises an outer circumferential ring on its outer radial circumference.

8. The fan according to claim 7, wherein the outer circumferential ring has a radial thickness that is equivalent to 0.002 to 0.015 of the fan wheel diameter (Dv).

9. The fan according to claim 7, wherein the outer circumferential ring completely surrounds the stator and is non-angular in axial cross section.

10. The fan according to claim 7, wherein the outer circumferential ring extends radially outwards in the direction of flow at an angle β of 5-25° relative to the rotational axis.

11. The fan according to claim 7, wherein the outer circumferential ring extends radially outwards in the direction of flow at an angle β of 5-10° relative to the rotational axis.

12. The fan according to claim 1, wherein the stator hub extends radially outwards in the axial direction of flow at an angle α of up to 60° relative to the rotational axis.

13. The fan according claim 12, wherein the angle α is greater than the angle β.

14. The fan according to claim 1, wherein the stator hub and the outer circumferential ring together form a nozzle that has a flow cross section that diminishes in the direction of flow.

* * * * *